US006892397B2

(12) United States Patent
Raz et al.

(10) Patent No.: US 6,892,397 B2
(45) Date of Patent: May 17, 2005

(54) GLOVE WITH INTEGRATED LIGHT

(75) Inventors: Kurt Allen Raz, Tigard, OR (US); Mark Allen Olmstead, Lake Oswego, OR (US); Thomas Fitzgerald, Lake Elizabeth, CA (US)

(73) Assignee: Anza Sport Group, Inc., Valencia, CA (US)

( * ) Notice: Subject to any disclaimer, the term of this patent is extended or adjusted under 35 U.S.C. 154(b) by 0 days.

(21) Appl. No.: 10/336,085

(22) Filed: Jan. 3, 2003

(65) Prior Publication Data

US 2004/0128736 A1 Jul. 8, 2004

(51) Int. Cl.[7] ..... A41D 19/00
(52) U.S. Cl. ..... 2/160; 362/103
(58) Field of Search ..... 2/160, 161.1, 161.2–161.4, 2/161.6, 163; 362/570, 572, 103

(56) References Cited

U.S. PATENT DOCUMENTS

| | | | | | |
|---|---|---|---|---|---|
| 455,972 | A | | 7/1891 | Qudin et al. | |
| 914,975 | A | | 3/1909 | Radley | |
| 1,046,225 | A | | 12/1912 | Schindler | |
| 1,230,943 | A | | 6/1917 | Sundh | |
| 1,553,860 | A | | 9/1925 | Hopper | |
| 3,638,011 | A | * | 1/1972 | Bain et al. | 362/103 |
| 3,811,684 | A | * | 5/1974 | Tredway, Sr. | 473/212 |
| 4,249,233 | A | * | 2/1981 | Gatton | 362/103 |
| 4,422,131 | A | | 12/1983 | Clanton et al. | 362/186 |
| 4,561,122 | A | * | 12/1985 | Stanley et al. | 2/20 |
| 4,625,339 | A | * | 12/1986 | Peters | 2/160 |
| 5,086,378 | A | * | 2/1992 | Prince | 362/103 |
| 5,177,467 | A | | 1/1993 | Chung-Piao | 340/574 |
| 5,220,690 | A | * | 6/1993 | Hoos | 2/21 |
| 5,255,167 | A | * | 10/1993 | Toussaint et al. | 362/103 |
| 5,444,462 | A | | 8/1995 | Wambach | 345/158 |
| 5,448,458 | A | * | 9/1995 | Smyly, Jr. | 362/570 |
| 5,514,861 | A | | 5/1996 | Swartz et al. | 235/472 |
| 5,535,105 | A | | 7/1996 | Koenen et al. | 362/103 |
| 5,580,154 | A | | 12/1996 | Coulter et al. | 362/103 |
| 5,816,676 | A | | 10/1998 | Meyers et al. | 362/8 |
| 6,006,357 | A | * | 12/1999 | Mead | 2/160 |

FOREIGN PATENT DOCUMENTS

| | | | |
|---|---|---|---|
| DE | 668738 | C | 12/1938 |
| GB | 837648 | A | 6/1960 |
| GB | 2107571 | A | 5/1983 |

* cited by examiner

*Primary Examiner*—Katherine M Moran
(74) *Attorney, Agent, or Firm*—Koppel, Jacobs, Patrick & Heybl

(57) ABSTRACT

A glove with an integrated illumination device is disclosed, comprising a glove having a palm portion, a back portion, and a knuckle portion, and an electrical circuit that illuminates an illumination device when activated. The glove further comprises a first housing adjacent to the knuckle portion of the glove configured to contain the illuminating device. A second housing adjacent to the back portion of the glove is included and comprises a power source to power the electrical circuit, and a switch that, when activated, activates the electrical circuit, thereby supplying power to the illuminating device. Electrical conductors are included to interconnect the first and second housings.

18 Claims, 3 Drawing Sheets

GLOVE WITH INTEGRATED LIGHT

BACKGROUND OF THE INVENTION

1. Field of the Invention

This invention relates to the field of work and sport gloves, and particularly to a glove with an integrated light.

2. Description of the Related Art

Mechanics, plumbers, electricians and others use gloves every day for a variety of tasks, which include tasks that are performed in small, dark areas requiring dexterity as well as illumination. Different conventional ways of illuminating these areas include a hand held flashlight, or portable light mounted or hung adjacent to the area. Often times, however, it is awkward holding a flashlight while performing the task and there is no convenient location to mount or hang a light so that the desired area is effectively illuminated. Also, when working in the area the user's hands or arms can block the light.

Various devices have been developed having a light source that is mounted on a user's hand. U.S. Pat. No. 5,535,105 to Koenen Myers et al., entitled "Work Glove and Illuminator Assembly" discloses a surgical or worker glove having an illuminator in a light housing on one of the glove fingers, with the illuminator oriented to project a light beam distally of the glove. The light source for the illuminator can be self-contained within the light housing or can utilize fiber optics to transmit light to the illuminator from a remote light source. Another embodiment discloses a translucent glove wherein the output of the illumination means is disposed on the interior of the glove and the light shines through a fingertip of a glove.

One disadvantage of the glove in the Koenen Myers et al. patent is that its light housing is bulky and extends a significant distance above the surface of the finger. This can result in the housing interfering with a task being performed in a tight space. The fiber optic embodiments rely on a light source external to the gloves which adds complexity and cost. All of the embodiments have a light source attached to one of the glove fingers and as a task is being performed, the fingers move. This movement can result in the light moving from the desired area when performing the task. Further, the light on the fingertip embodiment would be blocked by any dirt, oil, grease, blood, etc. that accumulates on the glove fingers during use.

U.S. Pat. No. 4,422,131 to Clanton, et al., entitled "Finger Light" discloses a light worn on, and turned on by, a finger. It has a substantially hollow tubular housing with an opening at one end through which a finger can be inserted. The light source is self-contained in the opposite closed end of the housing. Pressure from the finger activates a light, which provides illumination through the closed end.

Like the light in the Koenen Myers et al. patent, one disadvantage of this arrangement is that the light emanates from the end of the finger, and as the fingers move during a task, the light can move off the desired area. This device also prevents bending of the portion of the finger within the tubular housing, reducing dexterity. The housing is also made of rubber or plastic and the light source is arranged at end of the finger, such that the user's tactile feel is blocked.

U.S. Pat. No. 3,638,011 to Bain, et al., entitled "Hand Glove and Light Attachment Therefore" discloses a glove with a light housing that is attached to a finger and extends a significant distance above the surface of the finger. This configuration is bulky, cumbersome, and would likely be damaged when used in tight spaces. Another disadvantage of this arrangement is that power is supplied to the light source from a bulky battery unit on the wrist, which could interfere with use of the glove in tight space and/or could also be damaged. Like the gloves above, the light source in this device is also mounted on the finger such that it will move from the desired area during use.

U.S. Pat. No. 1,230,943 to Sundh, entitled "Portable Light," discloses a glove with a leather strip that extends transversely across the back of the glove and also longitudinally toward the wrist. A number of light sockets are riveted to the strip, and near the wrist a pocket is included for batteries to power lights mounted in the sockets. However, the lights on the back of the hand are unprotected and extend a distance above the surface of the hand. The power supply is arranged on the back of the wrist and also extends a distance above the surface of the wrist. Yet again, this configuration is cumbersome, and would likely be damaged and unusable in tight spaces.

SUMMARY OF THE INVENTION

One embodiment of an apparatus for illuminating a work area according to the present invention, comprises a glove to be worn on a user's hand. A first housing is mounted on the exterior of the glove, the housing having a rounded exterior surface. An illumination device is housed within the first housing to illuminate an area in front of the user's extended fingers. The first housing is mounted in a location on the glove such that the light from said illumination device does not substantially move from the work area when the user's fingers move. The illumination device is disposed within the first housing to protect it from damage. A second housing is also mounted to the glove and comprises a power source and a power switch. Electrical conductors are included between the first and second housings for transmitting power to the illumination device from the power source when the power switch is activated.

A second embodiment of an apparatus for illuminating a work area according to the present invention also comprises a glove. A first housing is mounted to the glove, adjacent to the knuckle portion of the index finger section, between the index finger and thumb sections. A second housing is mounted to the glove and contains a fiber optic light source, and a switch for illuminating said fiber optic light source. One or more optical fibers run between the first and second housings, with the light from the fiber optic light source directed into one end of the optical fibers and down the optical fibers. The other end of the optical fibers are housed within the first housing such that light emitting from the optical fibers illuminates a work area in front of the user's extended fingers.

Further features and advantages of the invention will be apparent to those skilled in the art from the following detailed description, taken together with the accompanying drawings.

DETAILED DESCRIPTION OF THE INVENTION

Figure 1:
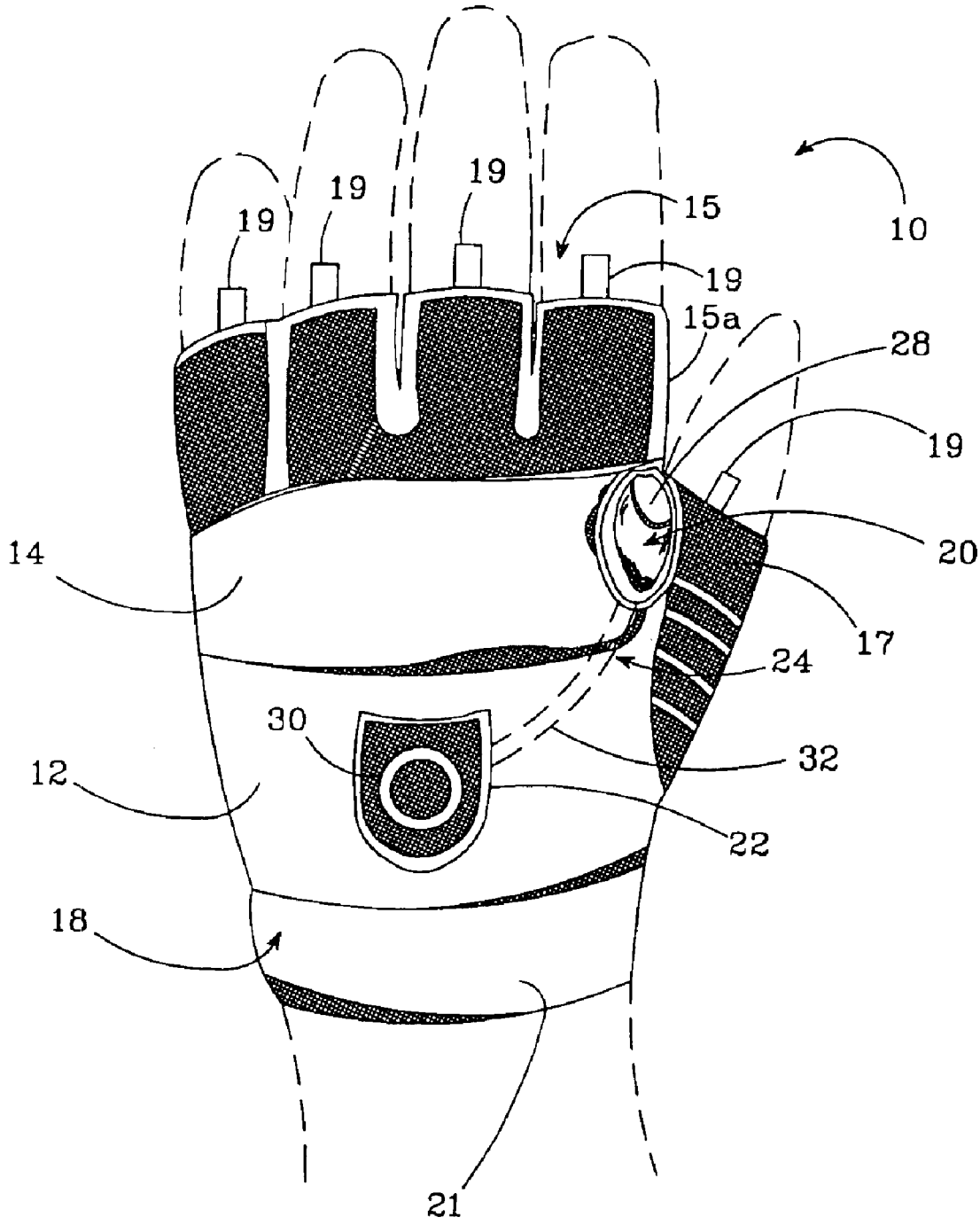
FIG. 1 is a top plan view of one embodiment of the present invention.
Figure 2:
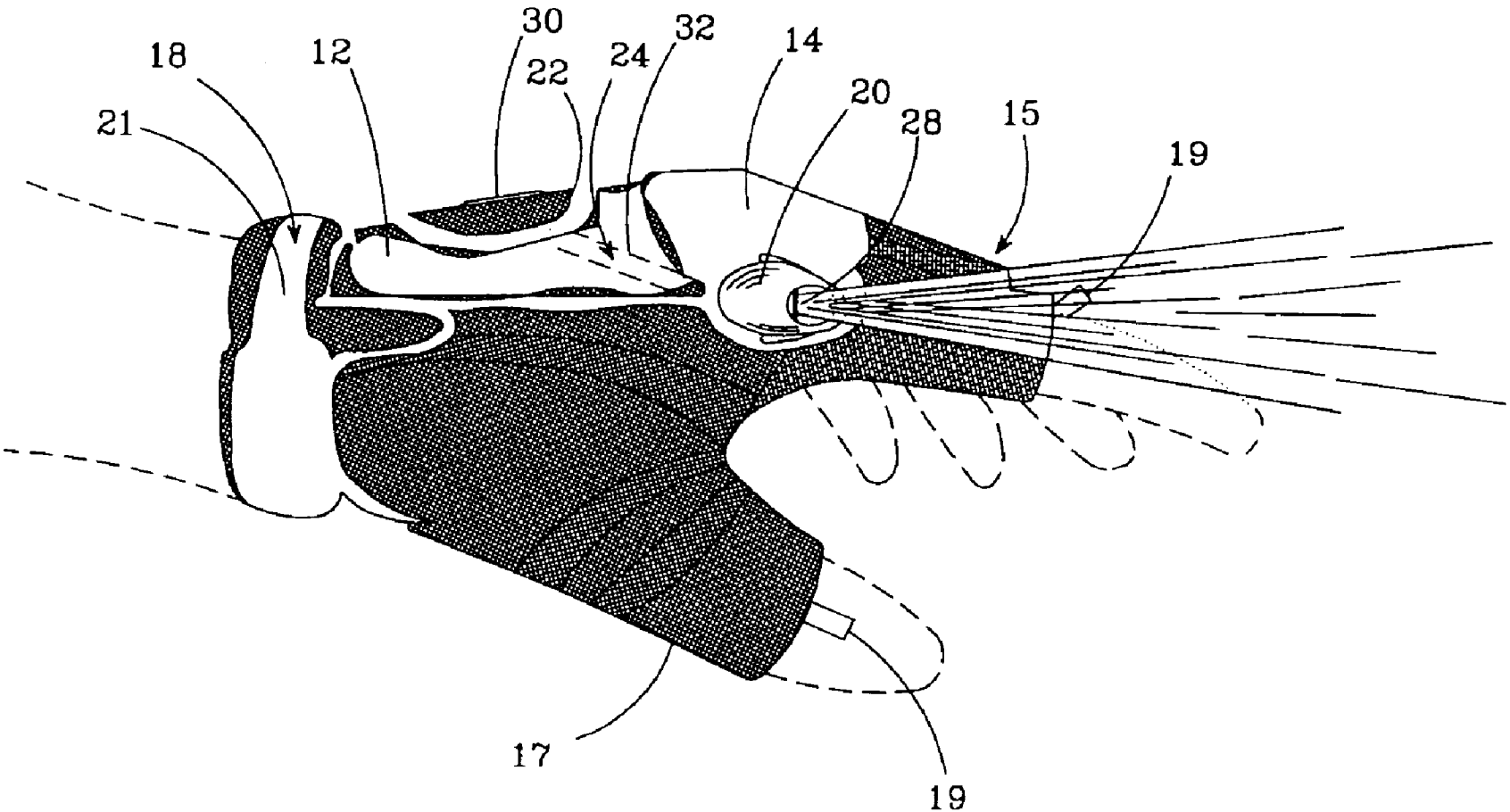
FIG. 2 is a side plan view according to another embodiment of the present invention.

FIGS. 1 and 2 show an embodiment of a glove 10 according to the present invention having integrated light. The glove 10 has a back portion 12, a knuckle portion 14, finger sections 15, a palm portion 16, a thumb portion 17 and a wrist portion 18. The knuckle portion 12 is preferably made of a durable and flexible material that protects the user's knuckles and also allows mobility of the user's fingers, with a suitable material being a commercially available material known as Airprene®. The palm section 16 and the inside surfaces of the finger and thumb sections 15, 17 should be made of a durable and breathable material such as synthetic leather. The back section 12 and the backs of the fingers and thumb sections 15, 17 should be made of a breathable material, such as commercially available Spandex®.

Glove 10 is shown as a fingerless design with no covering over approximately the last half of the user's fingers and thumb. This allows the user to have maximum tactile feel during use. The fingers and thumb portions 15, 17 can each include a pull-tab 19 that are used to pull the glove 10 off the user's hand. Alternative embodiments of the glove 10 can include full finger and thumb coverings, to be fingerless on some of the finger and thumb portion 15, 17. The glove 10 also includes a closure strap 21 on the wrist section around the user's wrist. The strap is held in place against the surface of the glove by a hook and loop closure.

Glove 10 further includes a first housing 20, which is typically adjacent knuckle portion 14 of glove 10, and a second housing 22, which is typically adjacent to back portion 12 of glove 10. In one embodiment as shown in FIGS. 1 and 2, the second housing is generally located between the wrist and knuckles of the user's hand. The first and second housings 20, 22 are typically made of molded plastic but may be made from another suitable material such as rubber.

Glove 10 also includes an electrical circuit 24, which includes a power source (shown in FIG. 4), that powers circuit 24 and an illumination device 28. Circuit 24 also includes an internal switch (shown in FIG. 4) which is activated by a switch push button 30, with both the internal switch and switch push button 30 being on the second housing. When the internal switch is activated, the circuit 24 allows illumination device 28 to be connected to power source via cabling 32, thus powering illumination device 28. Illumination device 28 may be a light emitting diode (LED), an incandescent bulb, fluorescent bulb or another type of illuminating device such as a laser. Illumination device 28 may also be the end of a fiber optic cable.

The glove 10 includes an inner lining (not shown) and the cabling 32 is typically integrated into glove 10 between the inner lining and the glove's back and knuckle portions 12, 14. With this arrangement the cabling does not contact the user's hand, and the back and knuckle portions 12, 14 protect the cabling 32 from damage during use. Cabling 32 preferably comprises two electrical conductors that are each covered by an insulating material. In other embodiments the second housing 22 can house a light source and the cabling 32 can be optical fibers that transmit light from the second housing 22 to the first housing 20.

First housing 20 is configured to hold illumination device 28 such that the device illuminates objects toward the user's extended fingers. First housing 20 can be located in many different locations on the glove 10 such as the back portion 12 and the palm portion 16, with a preferred location being adjacent to the knuckle portion 14, near the index finger section 15*a*. First housing 20 extends very little above the surface of the glove 10, with typical height of the housing being in the range of 3 to 20 millimeters and preferred height being approximately 12 millimeters. This arrangement reduces the chances that the first housing 20 will interfere with use in confined areas, or be damaged during use. Furthermore, first housing 20 does not appreciably extend laterally along the glove 10, thus further reducing the likelihood that illumination device 28 will be damaged during use.

In its preferred location, the first housing 20 is not mounted on the user's fingers or thumb and is located such that it moves very little when the user's fingers move. This allows the light from the device 28 to remain on the desired work area while the user is performing a task. For instance, the user can unscrew a bolt with the thumb and forefinger and light from the illumination device generally remains on the desired work area while the fingers move. In other embodiments, the first housing 20 may be configured to direct illumination device 28 in other directions or can be adjustable so that the user can alter the direction of the light emitted from the device 28.

Second housing 22 can be located in many different locations on the glove 10, but is preferably located adjacent to back portion 12. It is formed such that it is an integral part of glove 10 and does not appreciably extend above the surface of the glove 10, thus reducing the chances that the user of the housing will interfere with use in a confined area, or will be damaged during use. The height of the second housing 22 is typically in the range of 3 to 20 millimeters, with a preferable height being approximately 13 millimeters.

Figure 3:
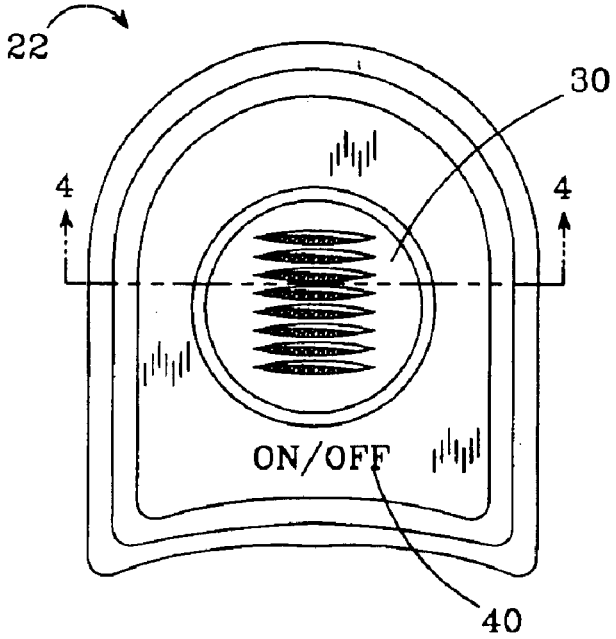
FIG. 3 is a top plan view of a switch according to an embodiment of the invention.

FIG. 3 shows one embodiment of a second housing 22 according to the present invention. As described above, the switch push button 30 is actuated by the user to turn the illumination device 28 on and off. Using a push button switch 30 arrangement keeps the height of the second housing 22 lower than if other switch arrangements were used, such as a toggle switch. Second housing 22 may also include signage 40 to direct the user to the area of second housing 22 to depress for turning the illumination device 28 on or off.

Figure 4:
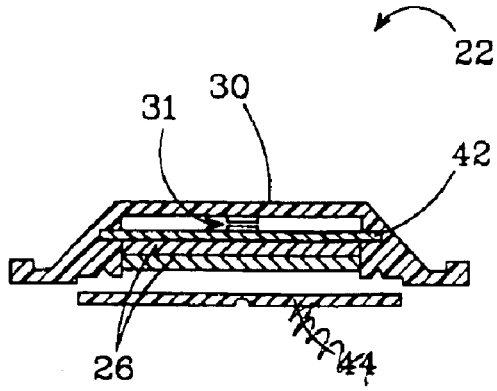
FIG. 4 is a sectional view of the switch in FIG. 3, taken along section lines 4—4.

FIG. 4 is a sectional view of second housing 22 as shown in FIG. 3. Second housing 22 is configured to hold an internal switch 31 that is activated by depressing the switch push button 30. A circuit board 42 is included that holds the switch 31 and can also hold other interconnected electrical components for operation of the circuit 24. A power source 26 is included that powers the electrical circuit 24 formed by illumination device 28, cabling 32, switch 31, and power source 26. The power source 26 preferably comprises one or more standard batteries although other power sources can be used, such as rechargeable batteries.

Figure 5:
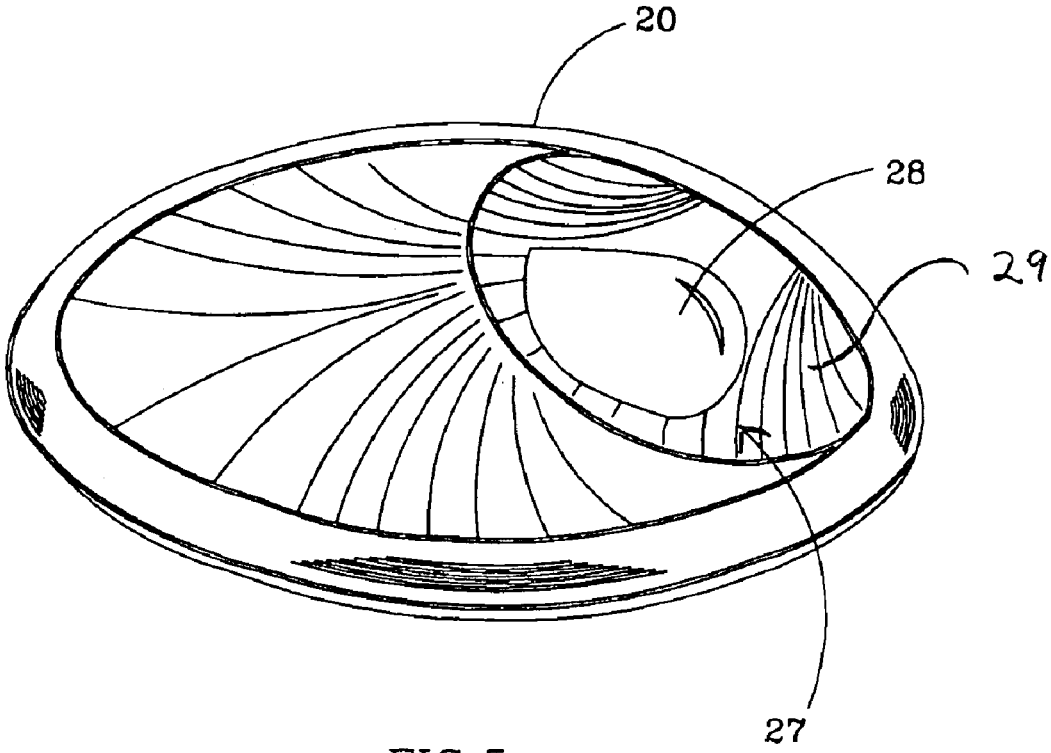
FIG. 5 is a side plan view of a housing and light according to an embodiment of the present invention.

FIG. 5 is a close up, side plan view of the first housing 20 and illumination source 28. First housing 20 has generally rounded surface so that it does not present vertical surfaces that would catch when using the glove 10 in a confined area. The first housing 20 also comprises a cutout 27 that is formed to house an illumination device 28. When installed in the cutout 27, the illumination device 28 is below the outside surface of the remainder of the first housing 20, which helps protect the illumination device 28 from damage. The surface of the cutout 27 can be covered with a layer a reflective material 29 such that the light emitted by illumination device 28 reflects outwardly, toward the desired work area, and the light appears brighter than if the reflected material were not included.

While particular embodiments of the invention have been shown and described, numerous variations and alternate embodiments will occur to those skilled in the art. Accordingly, it is intended that the invention be limited only in terms of the appended claims.

We claim:

1. An apparatus for illuminating a work area, comprising:

a glove to be worn on a user's hand, said glove comprising an interior surface adjacent to the hand and an exterior surface having a knuckle portion;

a first housing mounted on and integral to the exterior surface of said glove generally adjacent to said knuckle portion at the base of said index finger and not extending into the space between the thumb and index finger, said first housing having a rounded exterior surface;

a light emitting diode (LED) housed within said first housing with said LED arranged in said housing to emit a beam of light substantially parallel to the gloves exterior surface to illuminate an area beyond the end of the user's extended fingers, said first housing mounted in a location on the glove such that the light from said LED does not substantially move from the illuminated area when the user's fingers or thumb move, said LED disposed within said first housing to protect it from damage;

a second housing mounted to said glove and comprising a power source and a power switch; and electrical conductors between said first and second housings for transmitting power to said LED from said power source when said power switch is activated.

2. The apparatus of claim 1, wherein said first and second housings are small enough so that they will not substantially interfere with work being conducted by a user in a confined area.

3. The apparatus of claim 1, wherein said first housing can be manipulated to change the direction of illumination for said illumination device.

4. The apparatus of claim 1, wherein said glove further comprises a palm and back portions, wherein said back portion comprises a durable and flexible material.

5. The apparatus of claim 4, wherein said knuckle and back portions comprise a durable and flexible material.

6. The apparatus of claim 4, wherein each said knuckle portion extends partially down the user's respective thumb and finger, at least one of said finger or thumb knuckle portions having a pull-tab that aids the user in removing said glove from the user's hand.

7. The apparatus of claim 1, wherein said first housing is made of molded plastic.

8. The apparatus of claim 1, wherein said first housing is made of rubber compound.

9. The apparatus of claim 1, wherein said first housing includes a cutout configured to house and protect said LED.

10. The apparatus of claim 9, wherein the surface of said cutout is covered with a reflective material to reflect light from said LED toward said illumination area.

11. The apparatus of claim 1, wherein said second housing is located on said back portion of said glove between the user's knuckles and wrist.

12. The apparatus of claim 1, wherein said second housing is made of molded plastic.

13. The apparatus of claim 1, wherein said inner surface comprises an inner lining and said exterior surface comprises an exterior layer, said electrical conductors between said lining and exterior layer such that said conductors do not contact the user's hand or fingers and said conductors are protected from damage.

14. The apparatus of claim 1, wherein said power source is a battery.

15. An apparatus with an integrated light, comprising:

a glove having a palm portion, a back portion, and a knuckle portion;

an electrical circuit integral with said glove and comprising a power source, an illumination device and electrical conductors between said power source and illumination device, said illumination device generating light when energized by said power source;

a first housing adjacent to said knuckle portion of said glove on the back portion of said glove and configured to house said illuminating device said illumination device arranged to project a beam of light substantially parallel to the back portion of said glove to illuminate an area beyond the end of the user's extended fingers, the illumination from said illumination device remaining substantially on said illuminated area when the user's fingers and thumb move, said first housing not extending into the space between the fingers or index finger and thumb; and a second housing adjacent to said back portion of said glove configured to hold said power source and a switch such that the power from said power source is conducted to said illumination device over said electrical conductors when said switch is activated.

16. The apparatus of claim 15, wherein the illuminating device is a device from the group consisting of a light emitting diode (LED), laser, solid state laser, fluorescent light and incandescent bulb.

17. The apparatus of claim 15, wherein said first and second housings are small enough so that they will not substantially interfere with work being conducted by a user in a confined area.

18. The apparatus of claim 15, wherein said illumination device comprises a light emitting diode (LED).

* * * * *